US005954588A

United States Patent [19]

Lien

[11] Patent Number: 5,954,588

[45] Date of Patent: Sep. 21, 1999

[54] ROTARY AND ROCKING TOY DEVICE

[76] Inventor: Shan-Feng Lien, 23-2 Hsu Chuo Gang, Nan Gang Village, Da Wei Hsiang, Tao Yuan Hsien, Taiwan

[21] Appl. No.: 09/131,946

[22] Filed: Aug. 10, 1998

[51] Int. Cl.[6] ..... A63G 1/20

[52] U.S. Cl. ..... 472/21; 472/5

[58] Field of Search ..... 472/4, 5, 14, 19, 472/21, 22, 23, 24, 135, 101, 103, 104, 105

[56] References Cited

U.S. PATENT DOCUMENTS

| | | | |
|---|---|---|---|
| 1,426,082 | 8/1922 | Jacobs et al. | 472/21 |
| 2,638,345 | 5/1953 | Norvell | 472/21 |
| 3,642,275 | 2/1972 | Ellico | 472/19 |
| 3,840,226 | 10/1974 | Sharp | 472/5 |
| 5,011,133 | 4/1991 | Meyers, Sr. | 472/22 |
| 5,246,400 | 9/1993 | Klucik | 472/21 |

*Primary Examiner*—Kien T. Nguyen
*Attorney, Agent, or Firm*—Alan Kamrath; Oppenheimer Wolff & Donnelly LLP

[57] ABSTRACT

A rotary and rocking toy device has four bottom seats, four roller wheels, four support frames, and four carriers. The support frames are connected together to form a cross shape. Each roller wheel is disposed on the respective bottom seat. Each support frame is connected to the respective roller wheel pivotally. Each carrier is connected to the respective support frame stably.

3 Claims, 5 Drawing Sheets

ROTARY AND ROCKING TOY DEVICE

BACKGROUND OF THE INVENTION

The present invention relates to a rotary and rocking toy device. More particularly, the present invention relates to a rotary and rocking toy device which has a ratchet wheel engaging with a chain.

A conventional rotary and rocking toy device has a bearing as a rotating center. However, the rotating center does not have any brake function to decrease the rotating speed of the conventional rotary and rocking toy device. A small child may be fallen down if the conventional rotary and rocking toy device rotates too fast. The conventional rotary and rocking toy de vice has a spring to rock under a carrier. If the spring is broken after a long period of usage, the broken spring mat hit the user. The user may be fallen down from the carrier.

SUMMARY OF THE INVENTION

An object of the present invention is to provide a rotary and rocking toy device which has a protection cover to protect the user against a broken spring.

Another object of the present invention is to provide a rotary and rocking toy device which has a roller wheel to rotate without rotating too fast.

Accordingly, a rotary and rocking toy device comprises at least a bottom seat, at least a roller wheel disposed on the bottom seat, at least a support frame connected to the roller wheel pivotally, and at least a carrier connected to the support frame stably.

In accordance with a first preferred embodiment of the present invention, a rotary and rocking toy device comprises four bottom seats, four roller wheels, four support frames, and four carriers. The support frames are connected together to form a cross shape. Each roller wheel is disposed on the respective bottom seat. Each support frame is connected to the respective roller wheel pivotally. Each carrier is connected to the respective support frame stably.

In accordance with a second preferred embodiment of the present invention, a rotary and rocking toy device comprises four bottom seats, four roller wheels, four support frames, four rocking frames, and four carriers. The support frames are connected together to form a cross shape. Each roller wheel is disposed on the respective bottom seat. Each support frame is connected to the respective roller wheel pivotally. Each carrier is connected to the respective support frame stably. Each rocking frame is disposed on a proximal portion of the respective support frame. A block plate is disposed on a bottom of the respective rocking frame. A rocking seat is disposed on the respective rocking frame. Two springs are inserted in the respective rocking seat. Two buffer devices are disposed on a bottom of the respective rocking seat. A ratchet wheel is disposed on an axle of the respective roller wheel. A chain surrounds the respective roller wheel and the respective rocking frame.

DETAILED DESCRIPTION OF THE INVENTION

Figure 1:
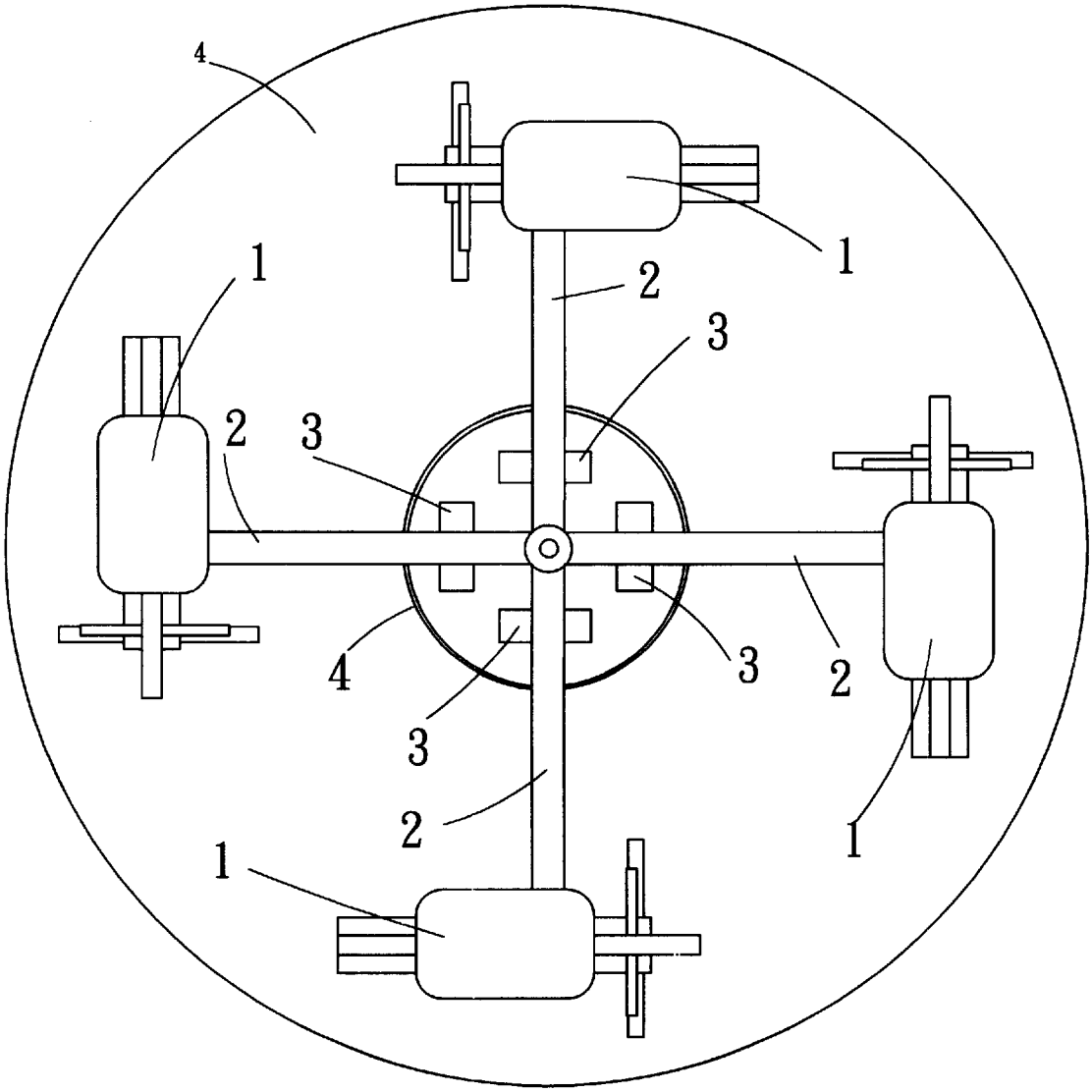
FIG. 1 is a top plan view of a rotary and rocking toy device of a preferred embodiment in accordance with the present invention.
Figure 2:
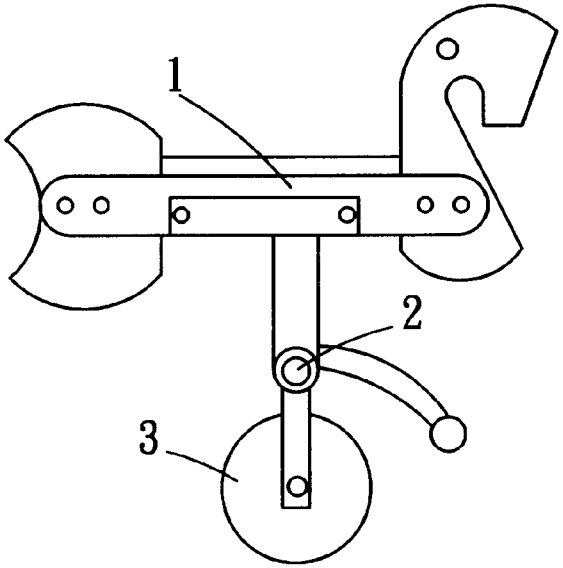
FIG. 2 is a partially front elevational view of a rotary and rocking toy device of a preferred embodiment in accordance with the present invention.
Figure 2A:
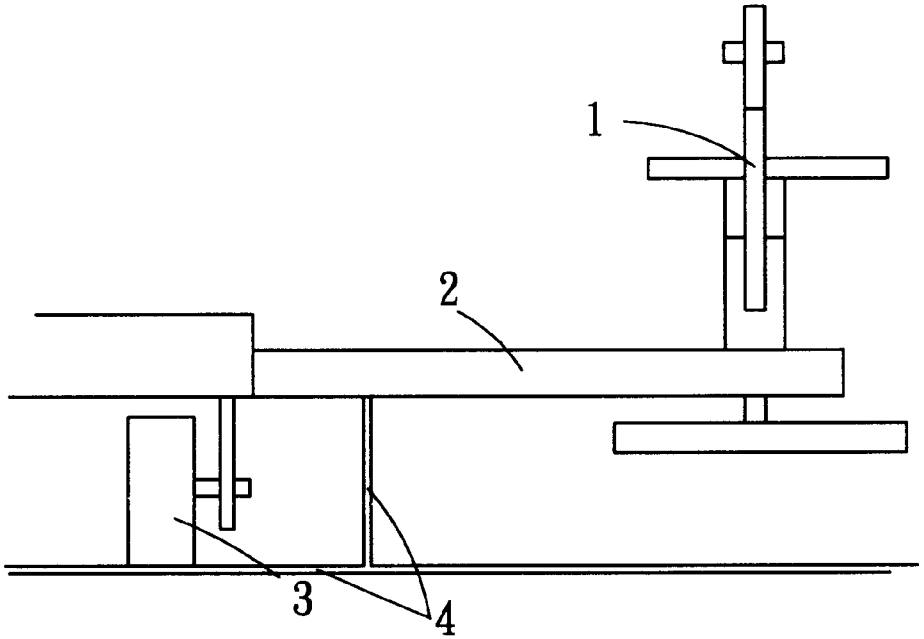
FIG. 2A is a partially side elevational view of a rotary and rocking toy device of a preferred embodiment in accordance with the present invention.

Referring to FIGS. 1, 2 and 2A, a first rotary and rocking toy device comprises four bottom seats 4, four roller wheels 3, four support frames 2, and four carriers 1. The support frames 2 are connected together to form a cross shape. Each roller wheel 3 is disposed on the respective bottom seat 4. Each support frame 2 is connected to the respective roller wheel 3 pivotally. Each carrier 1 is connected to the respective support frame 2 stably. The friction between the roller wheel 3 and the respective bottom seat 4 can decrease the rotating speed of the roller wheel 3.

Figure 3:
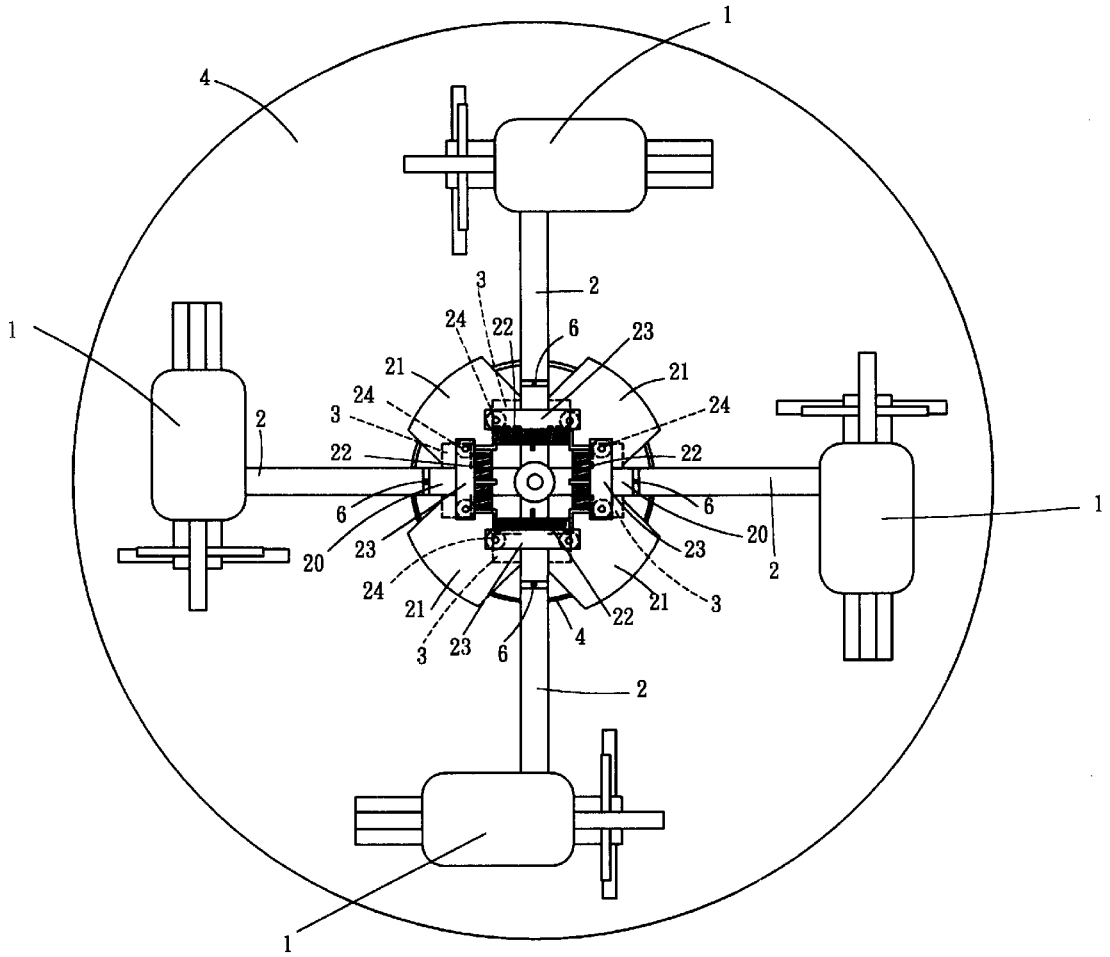
FIG. 3 is a top plan view of a rotary and rocking toy device of another preferred embodiment in accordance with the present invention.
Figure 4:
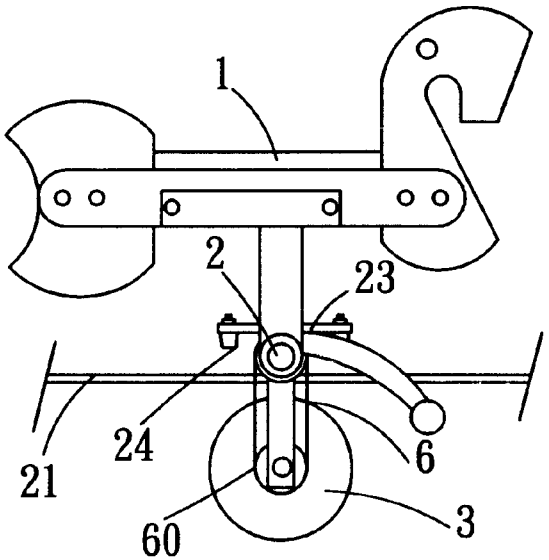
FIG. 4 is a partially front elevational view of a rotary and rocking toy device of another preferred embodiment in accordance with the present invention.
Figure 4A:
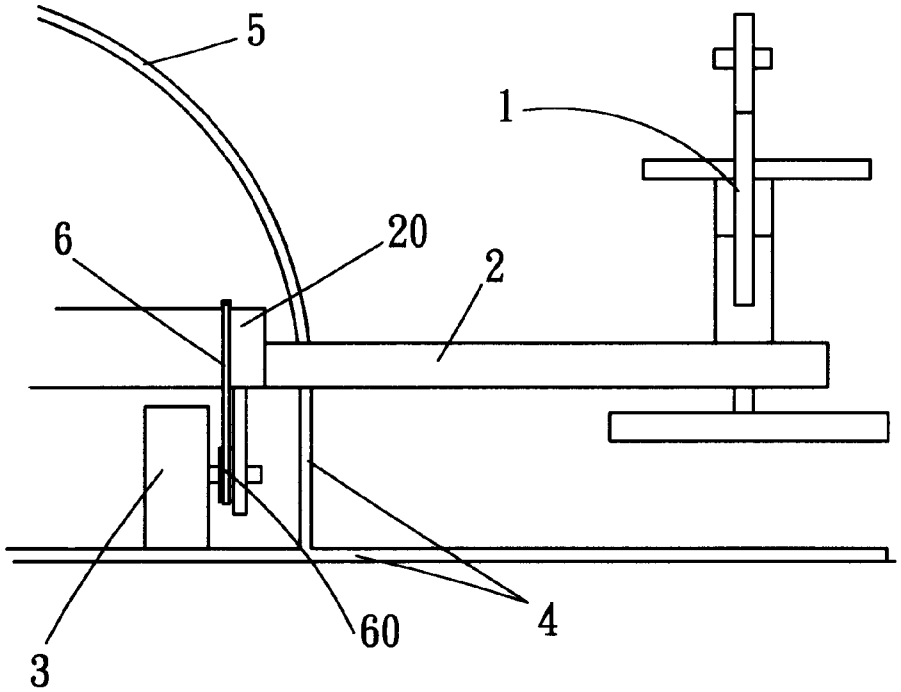
FIG. 4A is a partially side elevational view of a rotary and rocking toy device of another preferred embodiment in accordance with the present invention.
Figure 5:
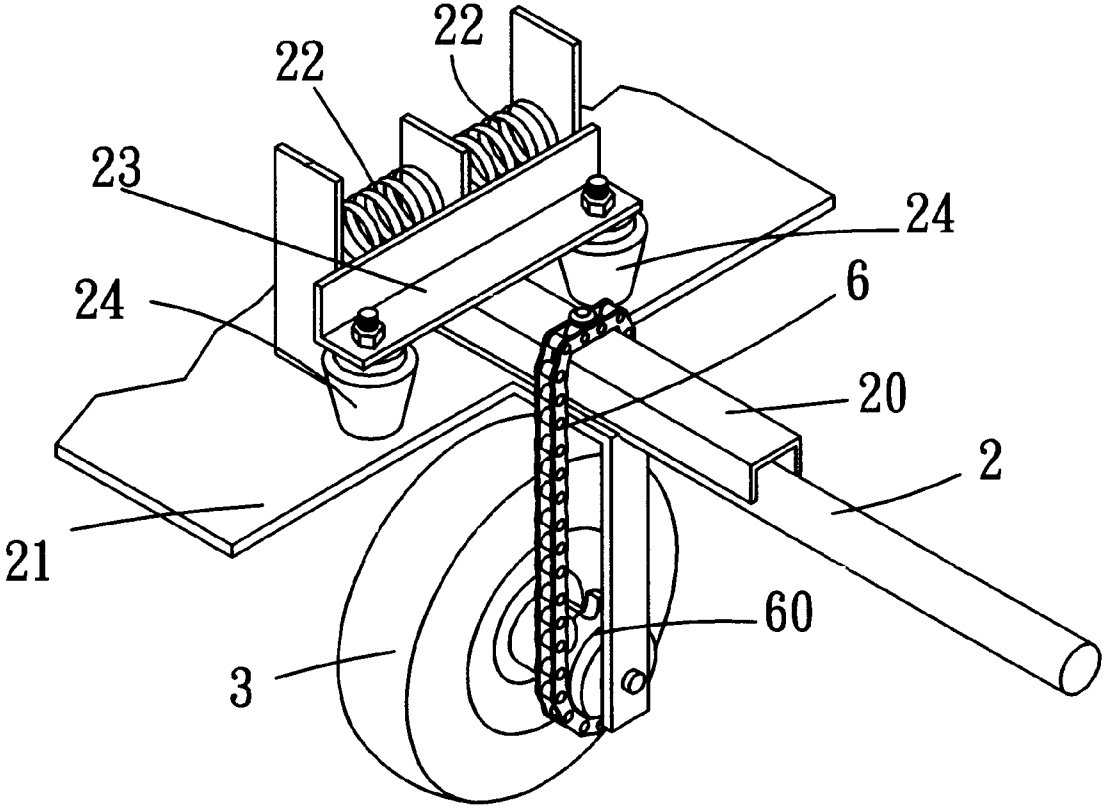
FIG. 5 is a partially perspective view of a rotary and rocking toy device of another preferred embodiment in accordance with the present invention.

Referring to FIGS. 3 to 5, a second rotary and rocking toy device comprises four bottom seats 4, four roller wheels 3, four support frames 2, four rocking frames 20, and four carriers 1. The support frames 2 are connected together to form a cross shape. Each roller wheel 3 is disposed on the respective bottom seat 4. Each support frame 2 is connected to the respective roller wheel 3 pivotally. Each carrier 1 is connected to the respective support frame 2 stably. Each rocking frame 20 is disposed on a proximal portion of the respective support frame 2. A block plate 21 is disposed on a bottom of the respective rocking frame 20. A rocking seat 23 is disposed on the respective rocking frame 20. Two springs 22 are inserted in the respective rocking seat 23. Two buffer devices 24 are disposed on a bottom of the respective rocking seat 23. A ratchet wheel 60 is disposed on an axle of the respective roller wheel 3. A chain surrounds the respective roller wheel 3 and the respective rocking frame 20. A protection cover 5 covers the springs 22. The friction between the roller wheel 3 and the respective bottom seat 4 can decrease the rotating speed of the roller wheel 3.

When the user rocks on the carrier 1, the buffer devices 24 can contact the block plate 21. The springs 22 will force the respective rocking frame 20 returning to the level position. When the carrier 1 rocks forward, the chain 6 drives the roller wheel 3 to rotate. When the carrier 1 rocks rearward, the ratchet wheel 60 will rotate idly.

The invention is not limited to the above embodiment but various modification thereof may be made. Further, various changes in form and detail may be made without departing from the scope of the invention.

I claim:

1. A rotary and rocking toy device comprising, in combination:

at least a bottom seat, at least a roller wheel disposed on the bottom seat, at least a support frame connected to the roller wheel pivotally, and at least a carrier connected to the support frame stably, wherein a rocking frame is disposed on the support frame, a block plate is disposed on a bottom of the rocking frame, a rocking seat is disposed on the rocking frame, two springs are inserted in the rocking seat, two buffer devices are disposed on a bottom of the rocking seat, and a protection cover covers the springs.

2. A rotary and rocking toy device as claimed in claim 1, wherein a ratchet wheel is disposed on an axle of the roller wheel, and a chain surrounds the roller wheel and the rocking frame.

3. A rotary and rocking toy device comprising, in combination:

at least a bottom seat, at least a roller wheel disposed on the bottom seat, at least a support frame connected to the roller wheel pivotally, and at least a carrier connected to the support frame stably, wherein a ratchet wheel is disposed on an axle of the roller wheel, and a chain surrounds the roller wheel and the rocking frame.

* * * * *